US011465411B2

(12) United States Patent
Sasaki et al.

(10) Patent No.: US 11,465,411 B2
(45) Date of Patent: Oct. 11, 2022

(54) LIQUID DROPLET DISCHARGING APPARATUS

(71) Applicant: Brother Kogyo Kabushiki Kaisha, Nagoya (JP)

(72) Inventors: Zenichiro Sasaki, Nagoya (JP); Yasuhiro Nakano, Nagoya (JP); Yuta Toda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 86 days.

(21) Appl. No.: 16/804,866

(22) Filed: Feb. 28, 2020

(65) Prior Publication Data

US 2020/0276807 A1 Sep. 3, 2020

(30) Foreign Application Priority Data

Feb. 28, 2019 (JP) ..... JP2019-035133

(51) Int. Cl.
*B41J 2/045* (2006.01)

(52) U.S. Cl.
CPC ..... *B41J 2/04571* (2013.01); *B41J 2/0458* (2013.01); *B41J 2/04581* (2013.01)

(58) Field of Classification Search
CPC ... B41J 2/04571; B41J 2/0458; B41J 2/04581
See application file for complete search history.

(56) References Cited

U.S. PATENT DOCUMENTS 7,784,899 B2 8/2010 Shimazaki
9,486,998 B2 11/2016 Hayashi
2005/0104921 A1* 5/2005 Watanabe ..... B41J 2/0456 347/19
2007/0139461 A1 6/2007 Izuo
2008/0180483 A1 7/2008 Shimazaki
2015/0258780 A1 9/2015 Hayashi
2019/0210052 A1* 7/2019 Baker ..... H01L 51/56
2020/0094554 A1* 3/2020 Orihara ..... B41J 2/04588

FOREIGN PATENT DOCUMENTS

JP 4379477 B2 12/2009
JP 4929699 B2 5/2012
JP 6287387 B2 3/2018

* cited by examiner

*Primary Examiner* — Thinh H Nguyen

(74) *Attorney, Agent, or Firm* — Banner & Witcoff, Ltd.

(57) ABSTRACT

A liquid droplet discharging apparatus includes: a discharging head having: a liquid channel including a nozzle; and an energy applying part which applies, to liquid inside the liquid channel, discharge energy for discharging a liquid droplet from the nozzle; a signal outputting circuit which outputs signals depending on whether the nozzle satisfies a predetermined discharging performance; and a controller. The controller determines whether the nozzle satisfies the predetermined discharging performance, and estimates viscosity of the liquid inside the discharging head based on: viscosity estimation data in which discharge energy information and viscosity information are associated with each other, and a result of the determination performed in a case that the controller controls the energy applying part based on the discharge energy information and that the discharge energy is thereby applied to the liquid inside the liquid channel.

17 Claims, 9 Drawing Sheets

Fig. 8A

| | | DRIVING VOLTAGE | | |
|---|---|---|---|---|
| | | V1 | V2(>V1) | V3(>V2) |
| DRIVING WAVEFORM | SMALL DROPLET | W1a | W2a(>W1a) | W3a(>W2a) |
| | MEDIUM DROPLET | W1b(>W1a) | W2b(>W2a, W1b) | W2b(>W2a, W1b) |
| | LARGE DROPLET | W1c(>W1b) | W2c(>W2b, W1c) | W3c(>W3b, W2c) |

Fig. 8B

| | | DRIVING VOLTAGE | | |
|---|---|---|---|---|
| | | V1 | V2(>V1) | V3(>V2) |
| DRIVING WAVEFORM | SMALL DROPLET | 1 | 4 | 7 |
| | MEDIUM DROPLET | 2 | 5 | 8 |
| | LARGE DROPLET | 3 | 6 | 9 |

LIQUID DROPLET DISCHARGING APPARATUS

CROSS REFERENCE TO RELATED APPLICATION

The present application claims priority from Japanese Patent Application No. 2019-035133, filed on Feb. 28, 2019, the disclosure of which is incorporated herein by reference in its entirety.

BACKGROUND

Field of the Invention

The present disclosure relates to a liquid droplet discharging apparatus which discharges a droplet of liquid (liquid droplet) from a nozzle.

Description of the Related Art

As an example of the liquid droplet discharging apparatus which discharges a liquid droplet from a nozzle, there is a known ink-jet recording apparatus which performs recording by discharging droplets of ink (ink droplets) from nozzles. In this ink-jet recording apparatus, the ink inside pressure generating chambers is pressurized by piezoelectric elements so that the ink droplets are discharged from the nozzles. Further, the viscosity of the ink is calculated based on information corresponding to residual pressure waves generated inside the pressure generating chambers after the ink droplets have been discharged.

SUMMARY

In this ink-jet recording apparatus, it is necessary to obtain the information corresponding to the residual pressure waves so as to estimate the change in viscosity of the ink; a variety of kinds of processing is required for obtaining the information. Accordingly, a series of processing required for estimating the viscosity of the ink is complicated.

An object of the present disclosure is to provide a liquid droplet discharging apparatus capable of easily estimating the viscosity of liquid inside a discharging head.

According to an aspect of the present disclosure, there is provided a liquid droplet discharging apparatus including: a discharging head having: a liquid channel including a nozzle; and an energy applying part configured to apply, to liquid inside the liquid channel, discharge energy for discharging a liquid droplet of the liquid from the nozzle; a signal outputting circuit configured to output signals depending on whether the nozzle satisfies a predetermined discharging performance; and a controller, wherein the controller is configured to perform determination as to whether the nozzle satisfies the predetermined discharging performance; and the controller is configured to estimate viscosity of the liquid inside the discharging head based on: viscosity estimation data in which discharge energy information regarding the discharge energy and viscosity information regarding the viscosity of the liquid inside the liquid channel are associated with each other, and a result of the determination performed in a case that the controller controls the energy applying part based on the discharge energy information and that the discharge energy is thereby applied to the liquid inside the liquid channel.

In the present disclosure, it is possible to estimate the viscosity of the liquid inside the liquid channel based on the viscosity estimation data, in which the discharge energy information and the viscosity information are associated with each other, and based on the result of the determination, as to whether or not the nozzle satisfies the predetermined discharge performance, performed in the case that the controller controls the energy applying part based on the discharge energy information and that the discharge energy is thereby applied to the liquid inside the liquid channel Since the viscosity of the liquid inside the liquid channel can be estimated easily based on the viscosity estimation data and the result of the determination, any complicated processing is not required.

BRIEF DESCRIPTION OF THE DRAWINGS

FIG. 8A is a view depicting a table in which kinds of driving voltages and kinds of ink droplets are associated with maximum values of the viscosity of dischargeable ink, and FIG. 8B is a view depicting a table in which the kinds of driving voltages and the kinds of ink droplets are associated with the order of settings thereof.

DESCRIPTION OF THE EMBODIMENTS

In the following, an embodiment of the present disclosure will be explained.

<Overall Configuration of Printer>

Figure 1:
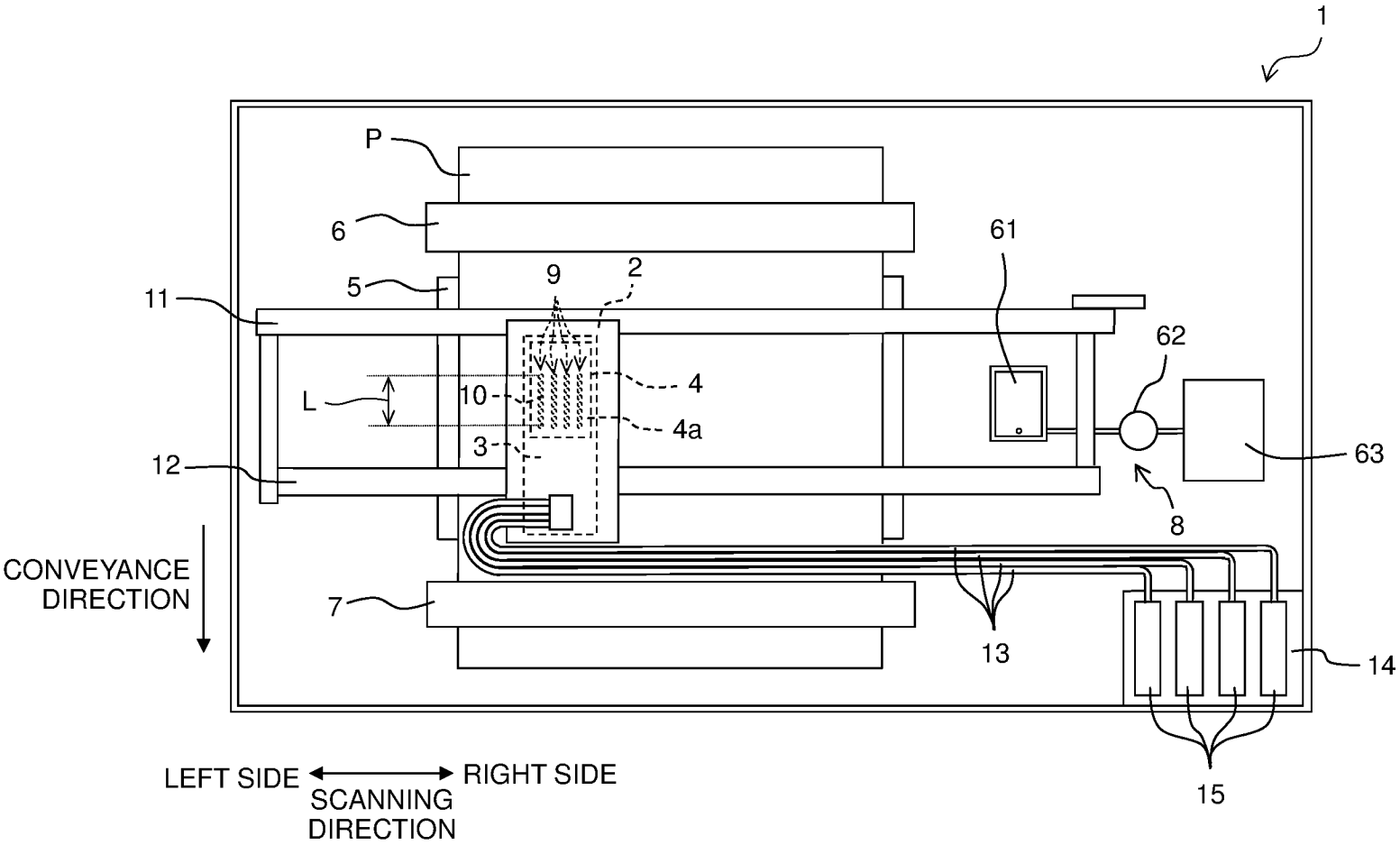
FIG. 1 is a view schematically depicting the configuration of a printer according to an embodiment of the present disclosure.

As depicted in FIG. 1, a printer 1 according to the present embodiment (corresponding to a "liquid droplet discharging apparatus" of the present disclosure) is provided with carriage 2, a sub tank 3, an ink-jet head 4 (corresponding to a "discharging head" of the present disclosure), a platen 5, conveyance rollers 6 and 7, a maintenance unit 8, etc.

The carriage 2 is supported by two guide rails 11 and 12 extending in a scanning direction. The carriage 2 is connected to a carriage motor 86 (see FIG. 6) via a non-depicted belt, etc.; in a case that the carriage motor 86 is driven, the carriage 2 moves in the scanning direction along the guide rails 11 and 12. Note that in the following explanation, the right side and the left side in the scanning direction will be defined as depicted in FIG. 1.

The sub tank 3 is attached to the carriage 2. In this case, a cartridge holder 14 is provided on the printer 1, and four ink cartridges 15 are detachably installed in the cartridge holder 14. Black, yellow, cyan, and magenta inks are stored in the four ink cartridges 15, respectively, in this order from an ink cartridge 15 arranged on the right side in the scanning direction. The sub tank 3 is connected to the four ink cartridges 15 installed in the cartridge holder 14 via four tubes 13. With this, the four color inks are supplied from the four ink cartridges 15 to the sub tank 3.

The ink-jet head 4 is attached to the carriage 2, and is connected to a lower end part of the sub tank 3. The four color inks are supplied to the ink-jet head 4 from the sub tank 3. Further, the ink-jet head 4 discharges or jets the inks from a plurality of nozzles 10 formed in a nozzle surface 4*a* which is a lower surface of the ink-jet head 4. To provide more specific explanation, the nozzles 10 form four nozzle rows 9 which are arranged side by side in the scanning direction. Each of the nozzle rows 9 is formed of the nozzles 10 aligned in a conveyance direction which is orthogonal to the scanning direction over a length L. The black, yellow, cyan, and magenta inks are discharged from the nozzles 10 in this order from the nozzles 10 constructing a nozzle row 9 which is arranged on the right side in the scanning direction.

The platen 5 is arranged below the ink-jet head 4 and faces the nozzles 10. The platen 5 extends in the scanning direction over the entire length of a recording sheet P (corresponding to a "recording medium" of the present disclosure) and supports the recording sheet P from therebelow. The conveyance roller 6 is located on the upstream side in the conveyance direction with respect to the ink-jet head 4 and the platen 5. The conveyance roller 7 is located on the downstream side in the conveyance direction with respect to the ink-jet head 4 and the platen 5. The conveyance rollers 6 and 7 are connected to a conveying motor 87 (see FIG. 6) via non-illustrated gears, etc. In a case that the conveying motor 87 is driven, the conveyance rollers 6 and 7 are rotated so as to convey the recording sheet P in the conveyance direction.

The maintenance unit 8 is provided to perform a suction purge, as will be described later on, so as to discharge the ink(s) inside of the ink-jet head 4 from the nozzles 10. The maintenance unit 8 will be explained in detail later on.

<Ink-Jet Head>

Figure 2:
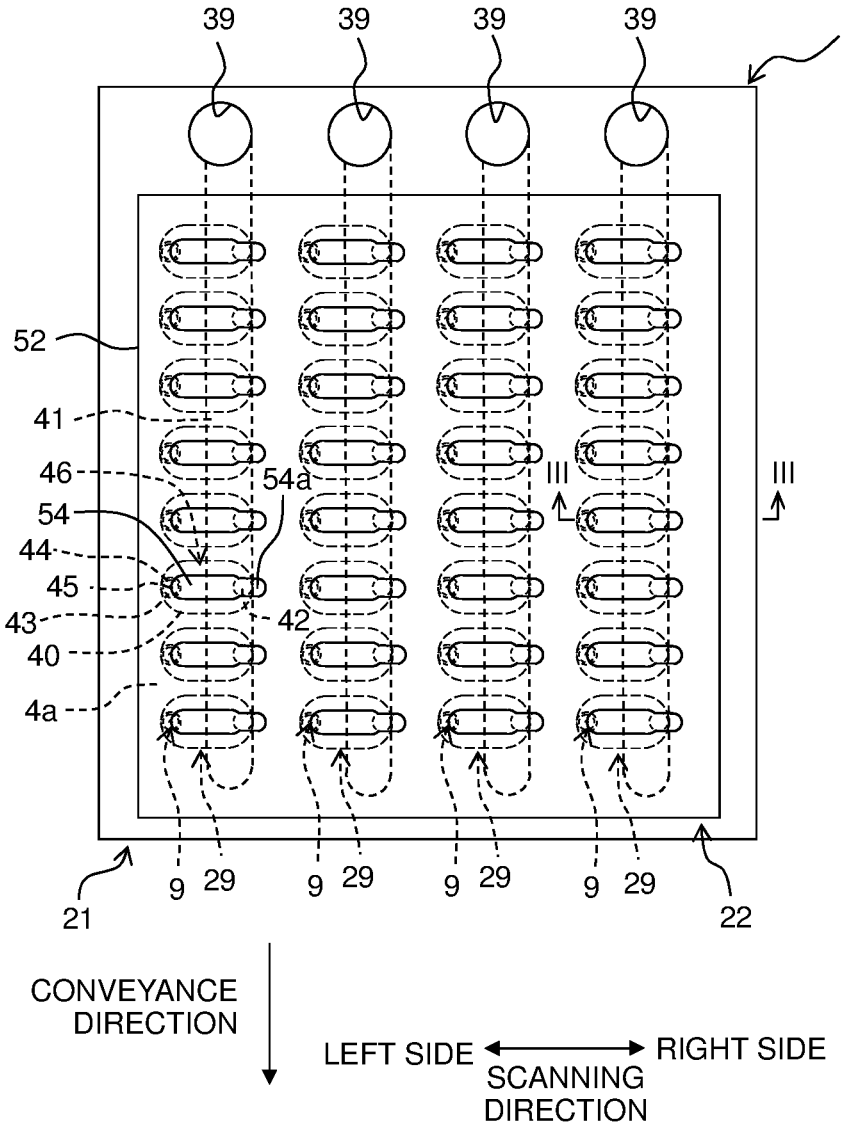
FIG. 2 is a plan view of an ink-jet head in FIG. 1.
Figure 3:
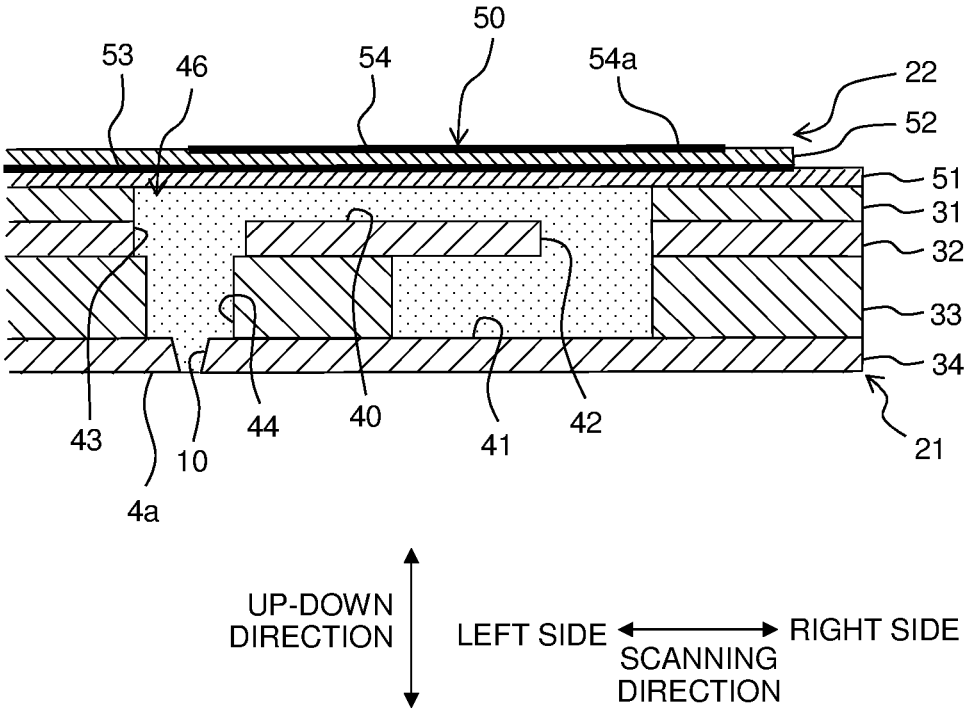
FIG. 3 is a cross-sectional view taken along a line in FIG. 2.

Next, the ink-jet head 4 will be explained in detail. As depicted in FIGS. 2 and 3, the ink-jet head 4 is provided with a channel unit 21 and a piezoelectric actuator 22.

<Channel Unit>

The channel unit 21 is formed by stacking four plates 31 to 34 from an upper position in this order. The plates 31 to 33 are formed of a metallic material such as stainless steel. The plate 34 is formed of a synthetic resin material such as polyimide.

The nozzles 10 are formed in the plate 34. The nozzles 10 form the four nozzle rows 9, as described above. Further, the lower surface of the plate 34 is the nozzle surface 4*a* of the ink-jet head 4. The plate 31 is formed with a plurality of pressure chambers 40. Each of the pressure chambers 40 has a shape which is elliptical in a plan view and of which longitudinal direction is the scanning direction. Further, the pressure chambers 40 correspond to the nozzles 10, respectively. A left end part in the scanning direction of each of the pressure chambers 40 overlaps, in the up-down direction, with one of the nozzles 10 corresponding thereto. With this, the plate 31 has four pressure chamber rows 29 which are arranged side by side in the scanning direction. Each of the four pressure chamber rows 29 is formed of the pressure chambers 40 aligned in the conveyance direction.

The plate 32 is formed with a plurality of circular-shaped through holes 42. The through holes 42 correspond to the pressure chambers 40, respectively. Each of the through holes 42 overlaps, in the up-down direction, with a right end part in the scanning direction of one of the pressure chambers 40 corresponding thereto. Further, the plate 32 is formed with a plurality of circular-shaped through holes 43. The through holes 43 correspond to the pressure chambers 40, respectively. Each of the through holes 43 overlaps, in the up-down direction, with a left end part in the scanning direction of one of the pressure chambers 40 and with one of the nozzles 10 corresponding thereto.

The plate 33 is formed with four manifold channels 41 corresponding to the four pressure chamber rows 29, respectively. Each of the manifold channels 41 extends in the conveyance direction and overlaps, in the up-down direction, with right end parts of the pressure chambers 40 constructing one of the pressure chamber rows 29 corresponding thereto. With this, each of the pressure chambers 40 is communicated with the manifold channel 41 corresponding thereto via one of the through holes 42. Further, supply ports 39 are provided on an end part on the upstream side in the conveyance direction of the manifold channels 41. The ink-jet head 4 is connected to channels inside the sub tank 3 via the supply ports 39. With this, the inks are supplied to the manifold channels 41 from the supply ports 39, respectively. Furthermore, the plate 33 is formed with a plurality of circular-shaped through holes 44. The through holes 44 correspond to the through holes 43, respectively. Each of the through holes 44 overlaps, in the up-down direction, with one of the through holes 43 and one of the nozzles 10 corresponding thereto. With this, the nozzles 10 are communicated with the pressure chambers 40 corresponding thereto via the through holes 43 and 44 corresponding thereto, respectively.

Moreover, individual channels 46 are formed in the channel unit 21. Each of the individual channels 46 is formed of the nozzle 10, the pressure chamber 40, the through holes 43 and 44 connecting the nozzle 10 to the pressure chamber 40, and the through hole 42 connecting the pressure chamber 40 to the manifold channel 41. Further, the individual channels 46 corresponding to each of the nozzle rows 9 are connected to one of the manifold channels 41. Note that in the present embodiment, an ink channel, which is inside of the ink-jet head 4 and in which the individual channel 46 and the four manifold channels 41 are combined, corresponds to a "liquid channel" of the present disclosure.

<Piezoelectric Actuator>

The piezoelectric actuator 22 is provided with a vibration plate 51, a piezoelectric layer 52, a common electrode 53 and a plurality of individual electrodes 54. The vibration plate 51 is formed of a piezoelectric material containing, as a main component thereof, lead zirconate titanate which is a mixed crystal of lead titanate and lead zirconate. The vibration plate 51 is arranged on the upper surface of the channel unit 21, and covers the pressure chambers 40. Note that unlike the piezoelectric layer 52 which is to be explained next, the vibration plate 51 may be formed of an insulative material which is different from the piezoelectric material.

The piezoelectric layer 52 is formed of the above-described piezoelectric material. The piezoelectric layer 52 is arranged on the upper surface of the vibration plate 51, and extends continuously over the pressure chambers 40. The common electrode 53 is arranged between the vibration plate 51 and the piezoelectric layer 52, and extends continuously over the pressure chambers 40. The common electrode 53 is connected to a head power source circuit 89 (see FIG. 6) via a non-depicted wiring member, etc. The common electrode 53 is maintained at the ground potential.

The individual electrodes 54 correspond to the pressure chambers 40, respectively. Each of the individual electrodes 54 has an elliptic shape in a plan view which is smaller to some extent than one of the pressure chambers 40 corresponding thereto. Each of the individual electrodes 54 is arranged on the upper surface of the piezoelectric layer 52, and overlaps in the up-down direction with a central part of one of the pressure chambers 40 corresponding thereto. Further, a right end part in the scanning direction of each of the individual electrodes 54 extends rightward in the scanning direction up to a location at which the right end part does not overlap, in the up-down direction, with one of the pressure chambers 40 corresponding thereto. A forward or tip end part of the right end part in the scanning direction of each of the individual electrodes 54 is a connection terminal 54. A non-depicted wiring member is connected to the connection terminal 54*a*. Each of the individual electrodes 54 is connected to a driver IC 59 (see FIG. 6) via the non-depicted wiring member.

A head power source circuit 89 (see FIG. 6, corresponding to a "voltage generator" of the present embodiment) is formed in the driver IC 59. The head power source circuit 89 generates a driving voltage. The driver IC 59 generates a waveform signal, and outputs the generated waveform signal individually to each of the individual electrodes 54, thereby applying the driving voltage generated by the head power source circuit 89 individually to each of the individual electrodes 54. For example, the waveform signal is a pulse signal; in a case that the level of the waveform signal is not less than a threshold value, the driver IC 59 applies the driving voltage generated in the head power source circuit 89 to the individual electrode(s) 54; in a case that the level of the waveform signal is less than the threshold value, the driver IC 59 releases the application of the driving voltage to the individual electrode(s) 54.

Further, corresponding to the above-described arrangement of the common electrode 53 and the individual electrodes 54, parts, of the piezoelectric layer 52, each of which is sandwiched between the common electrode 53 and one of the individual electrodes 54 are polarized in a thickness direction thereof. Further, in the piezoelectric actuator 22 having the above-described configuration, parts, which are formed of the individual electrodes 54, the vibration plate 51, the piezoelectric layer 52 and the common electrode 53 and which overlap with the pressure chambers 40 in the up-down direction construct driving elements 50 applying the pressure to the ink inside the pressure chambers 40, respectively (corresponding to an "energy applying part" of the present disclosure).

<Maintenance Unit>

Next, the maintenance unit 8 will be explained. As depicted in FIG. 1, the maintenance unit 8 is provided with a cap 61, a suction pump 62 and a waste liquid tank 63. The cap 61 is arranged on the right side in the scanning direction relative to the platen 5. Further, in a case that the carriage 2 is positioned at a maintenance position located on the right side in the scanning direction relative to the platen 5, the nozzles 10 face the cap 61.

Figure 6:
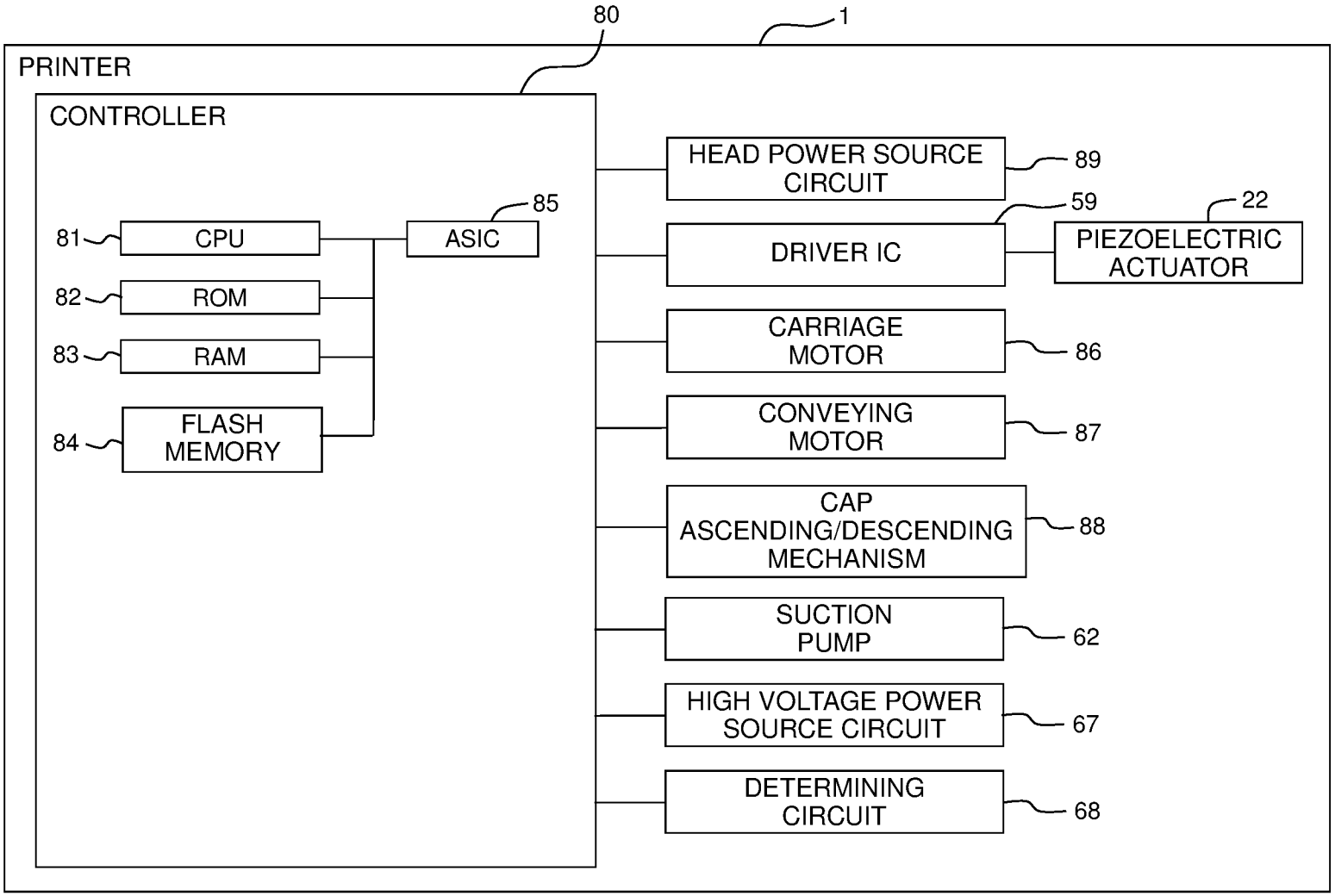
FIG. 6 is a block diagram depicting the electrical configuration of the printer.

Further, the cap 61 is capable of being raised and lowered (ascended/descended) by a cap ascending/descending mechanism 88 (see FIG. 6). Further, the cap 61 is raised by the cap ascending/descending mechanism 88 in a state that the carriage 2 is positioned at the maintenance position and that the nozzles 10 are made to face the cap 61. With this, an upper end part of the cap 61 makes tight contact with the nozzle surface 4*a* of the ink-jet head 4 so as to cover the nozzles 10 with the cap 61. Note that it is allowable that the cap 61 does not make tight contact with the nozzle surface 4*a* in a case that the cap 61 covers the nozzles 10. For example, it is allowable that the cap 61 makes tight contact with a non-depicted frame, etc., which is arranged to surround the nozzle surface 4*a* of the ink-jet head 4, in a case that the cap 61 covers the nozzles 10.

The suction pump 62 is, for example, a tube pump, etc., and is connected to the cap 61 and the waste liquid tank 63. Further, in the maintenance unit 8, in a case that the suction pump 62 is driven in a state that the nozzles 10 are covered by the cap 61 as described above, thereby performing a so-called suction purge wherein the ink inside the ink-jet head 4 is discharged from the nozzles 10. The ink discharged from the ink-jet head 4 is stored in the waste liquid tank 63.

Note that although the explanation has been made, for the sake of convenience, about the configuration wherein the cap 61 covers all the nozzles 10 and the ink inside the ink-jet head 4 is discharged from all the nozzles 10, the present disclosure is not limited to this case. For example, it is also allowable that the cap 61 is provided with a part covering nozzles 10 which construct a rightmost nozzle row 9 discharging the black ink, and another part covering nozzles 10 which construct remaining left-side three nozzle rows 9 discharging color inks (yellow, cyan and magenta ink), respectively. Further, it is allowable that the suction purge is performed to selectively discharge either the black ink or the color inks in the ink-jet head 4.

Figure 4:
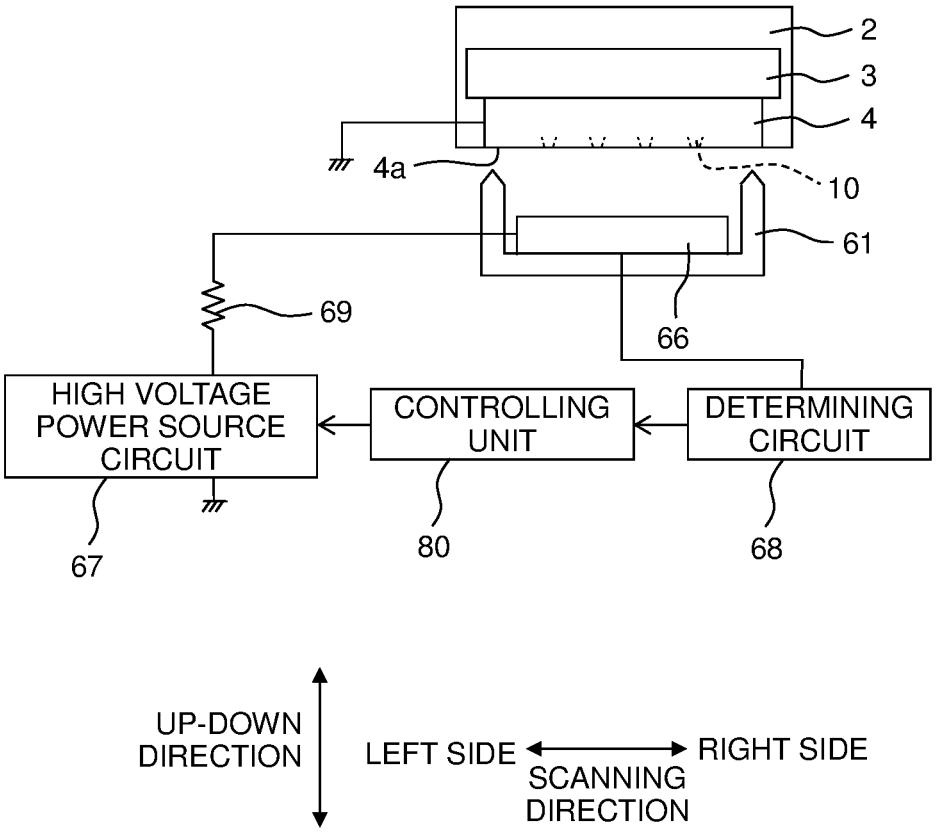
FIG. 4 is a view depicting a detecting electrode arranged inside a cap, and explaining the relationship of connection of the detecting electrode to a high voltage power source circuit and to a determining circuit.

Further, as depicted in FIG. 4, a detecting electrode 66 having a rectangular shape in a plane view is arranged inside the cap 61. The detecting electrode 61 is connected to a high voltage power source circuit 67 via a resistor 69. Further, a predetermined positive potential (for example, approximately 300 V) is applied to the detecting electrode 66 by the high voltage power source circuit 67. On the other hand, the channel unit 21 of the ink-jet head 4 is maintained at the ground potential. With this, there is generated a predetermined difference in the potential between the ink-jet head 4 and the detecting electrode 66. A determining circuit 68 (corresponding to a "signal outputting circuit" of the present disclosure) is connected to the detecting electrode 66. The determining circuit 68 compares the voltage value of a voltage signal outputted from the detecting electrode 66 with a threshold value Vt, and outputs a signal according to the result of the comparison.

Figure 5A:
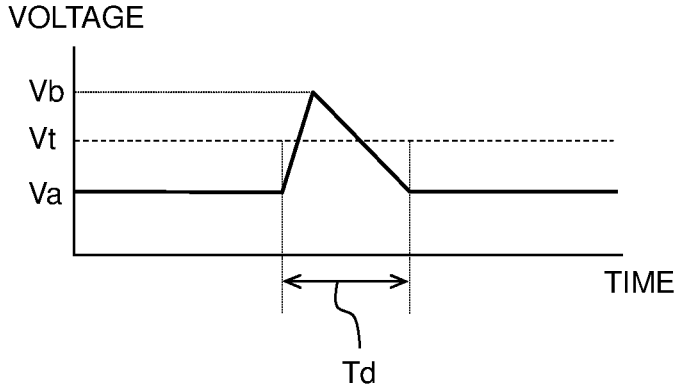
FIG. 5A is a view depicting a change in a voltage value of the detecting electrode in a case that ink is discharged from a nozzle.

To provide a more specific explanation, since the difference in the potential is generated between the ink-jet head 4 and the detecting electrode 66, the ink discharged from the nozzles 10 is charged with the electricity. The ink is discharged from the nozzle 10 toward the detecting electrode 66 in a state that the carriage 2 is positioned at the above-described maintenance position. In this situation, as depicted in FIG. 5A, the voltage value of the detecting electrode 66 is raised until the charged ink lands on the detecting electrode 66, and the voltage value reaches a voltage value Vb which is high as compared with a voltage value Va in a state that the ink-jet head 4 is not driven. Then, after the charged ink has landed on the detecting electrode 66, the voltage value of the detecting electrode 66 is lowered gradually to the voltage value Va. Namely, in a driving period Td during which the ink-jet head 4 is driven, the voltage value of the detecting electrode 66 changes.

Figure 5B:
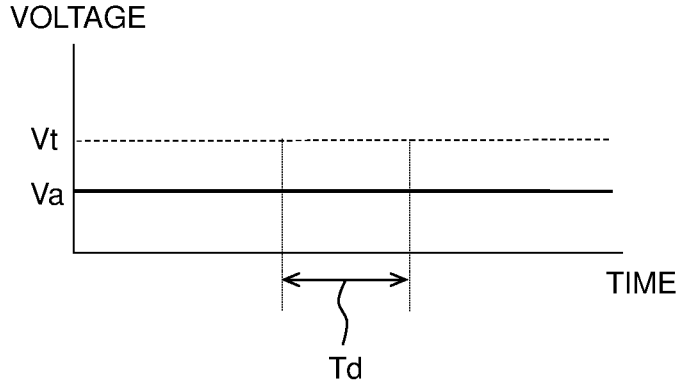
FIG. 5B is a view depicting the change in the voltage value of the detecting electrode in a case that the ink is not discharged from the nozzle.

On the other hand, in a case that the ink is not discharged from the nozzles 10, the voltage value of the voltage signal outputted from the detecting electrode 66 hardly changes during the driving period Td of the ink-jet head 4, as depicted in FIG. 5B. In view of this, a threshold value Vt ($Va<Vt<Vb$) is set in the determining circuit 68 so as to discriminate or distinguish these voltage values in the above two cases. Further, the determining circuit 68 compares a maximum voltage value of the voltage signal outputted from the detecting electrode 66 and the threshold value Vt during the driving period Td of the ink-jet head 4, and outputs a signal in accordance with the result of the determination.

Note that in this case, although the positive potential is applied to the detecting electrode 66 by the high voltage power source circuit 67, it is also allowable that a negative potential (for example, approximately −300 V) is applied to the detecting electrode 66 by the high voltage power source circuit 67. In such a case, contrary to the above-described case, that the inks are discharged from the nozzles 10 toward the detecting electrode 66 in the state that the carriage 2 is positioned at the above-described maintenance position, then the voltage value of the detecting electrode 66 is lowered until the charged ink lands on the detecting electrode 66.

<Electrical Configuration of Printer>

Next, an explanation will be given about the electrical configuration of the printer 1. The operation of the printer 1 is controlled by a controlling unit 80. As depicted in FIG. 6, the controlling unit 80 includes a Central Processing Unit (CPU) 81, a Read Only Memory (ROM) 82, a Random Access Memory (RAM) 83, a flash memory 84, an Application Specific Integrated Circuit (ASIC) 85, etc., and the controlling unit 80 controls the carriage motor 86, the conveying motor 87, the driver IC 59, the cap ascending/descending mechanism 88, the high voltage power source circuit 67, the suction pump 62, the head power source circuit 89, etc. Further, the above-described signal is inputted from the determining circuit 68 to the controlling unit 80.

Note that in the controlling unit 80, it is allowable that only the CPU 81 performs the respective processing. Alternatively, it is allowable that only the ASIC 85 performs the respective processing, or that the CPU 81 and the ASIC 85 perform the respective processing in a cooperative manner. Still alternatively, in the controlling unit 80, it is allowable that one CPU singly performs the respective processing, or that a plurality of CPUs 81 perform the processing in a shared manner. Alternatively, in the controlling unit 80, it is allowable that one ASIC 85 singly performs the respective processing, or that a plurality of ASICs 85 perform the processing in a shared manner.

<Control during Recording>

Next, an explanation will be given about processing performed in the printer 1 in a case of recording an image on a recording sheet P. In the printer, 1, an image, etc. is recorded on the recording sheet P by alternately executing a recording pass of driving the ink-jet head 4 so as to discharge the ink droplets from the nozzles 10 while driving the carriage motor 86 so as to move the carriage 2 in the scanning direction and a conveying operation of driving the conveying motor 87 so as to cause the conveying rollers 6 and 7 to convey the recording sheet P. Further, immediately before each recording pass, the printer 1 performs a flushing of driving the ink-jet head 4 so as to discharge the inks-ink inside the ink-jet head 4 from the nozzles 10 in a state that the carriage 2 is positioned at the maintenance position.

In the recording pass, the controlling unit 80 controls the driver IC 59 so that the driver IC 59 generates, based on image data of an image to be recorded, any one of three kinds of waveform signals corresponding respectively to three kinds of ink droplets which are a large droplet, a medium droplet and a small droplet and of which volumes are mutually different, and outputs individually for each of the individual electrodes 54. The three kinds of waveform signals are pulse signals of which pulse numbers and pulse widths are mutually different. Here, the "medium droplet" is a droplet of which volume is greater than that of the "small droplet", and the "large droplet" is a droplet of which volume is greater than that of the "medium droplet". Further, the controlling unit 80 controls the head power source circuit 89 so as to generate any one of driving voltages which are V1, V2 and V3, and applies the generated driving voltage to the driver IC 59. With this, the driving voltage is applied to each of the individual electrodes 54 from the head power source circuit 89, based on the waveform signal generated in the driver IC 59. Note that in the present embodiment, the controlling unit 80 and the driver IC 59 are combined to collectively correspond to a "controller" of the present disclosure.

<Processing Performed in Estimation of Ink Viscosity>

Figure 7:
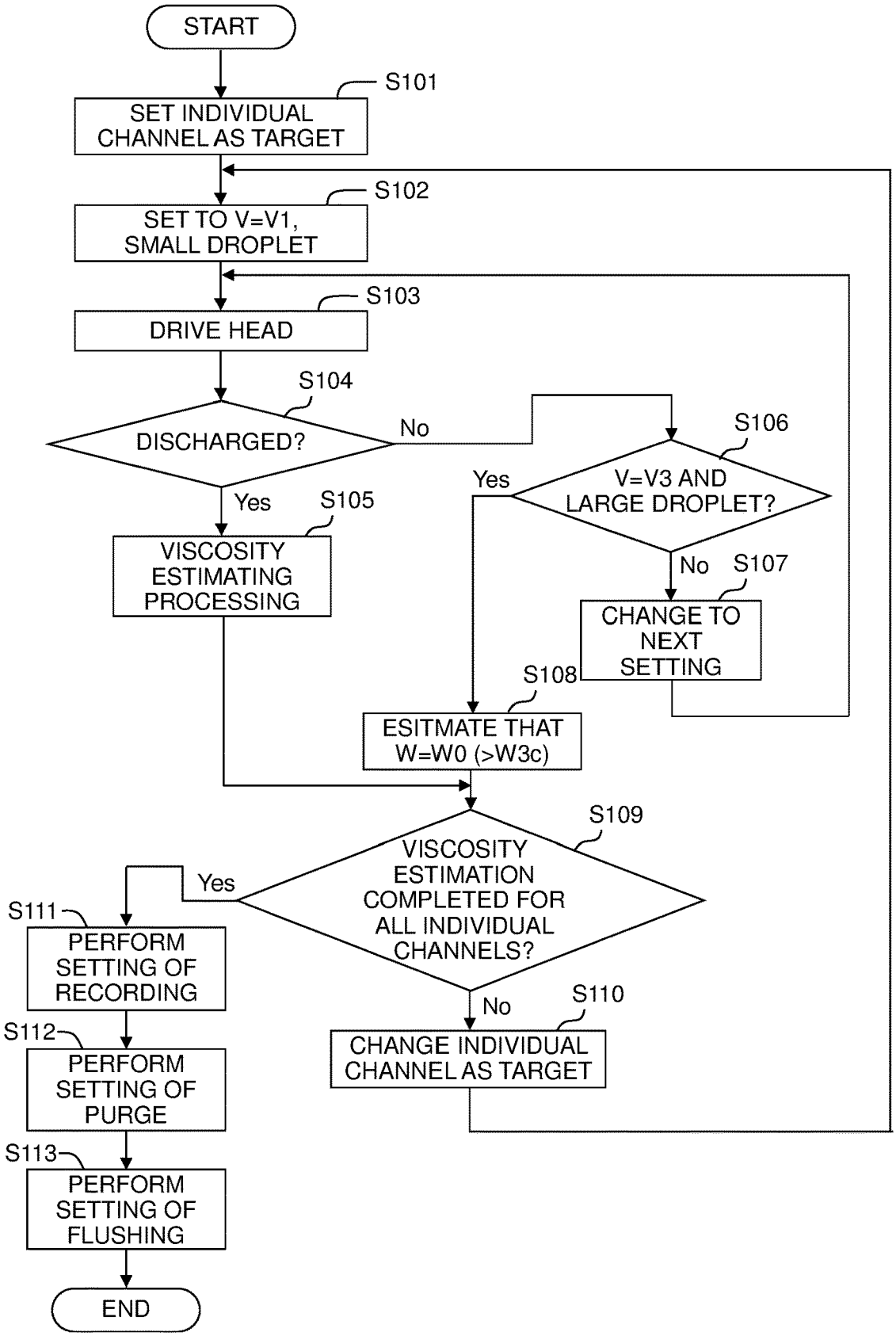
FIG. 7 is a flow chart depicting a flow of processing for estimating viscosity of the ink.

Next, an explanation will be given about a processing performed in a case of estimating the viscosity of the ink inside each of the individual channels 46 in the printer 1. In a case that the viscosity of the ink inside each of the individual channels 46 is estimated in the printer 1, the controlling unit 80 performs the processing in accordance with a flow as depicted in FIG. 7. Note that this processing is performed in a case that the recording of an image onto the recording sheet P is not performed in the printer 1.

To provide a more specific explanation, the controlling unit 80 firstly set one individual channel 46 of the ink-jet head 4 as a target or object which is subjected to the estimation of the viscosity (step S101). In step S101, it is allowable to set any individual channel 46 as the target of viscosity estimation. For example, among the individual channels 46 corresponding to a nozzle row 9 which is on the rightmost side, an individual channel 46 located on the upstream-most side of the conveyance direction is set as the target of viscosity estimation.

Next, the controlling unit 80 sets the driving voltage to be generated in the head power source circuit 89 to V1, and sets the kind of the ink droplet to the small droplet (step S102). Then, the controlling unit 80 drives the ink-jet head 4 by the settings made in step S102 (step S103). In step S103, the controlling unit 80 causes the head power source circuit 89 to apply the set driving voltage to the driver IC 59, and the controlling unit 80 causes a waveform signal, in accordance with the kind of the ink droplet which has been set, to be outputted from the driver IC 59 to a certain individual electrode 54 corresponding to the individual channel 46 as the target of estimation. By doing so, the driving voltage is applied to the certain individual electrode 54.

Next, the controlling unit 80 determines, based on the signal from the determining circuit 68, as to whether or not the ink is discharged from a certain nozzle 10 corresponding to the certain individual electrode 54 (whether or not the certain nozzle 10 satisfies a predetermined discharge performance) (step S104). In a case that the controlling unit 80 determines that the ink is discharged from the certain nozzle 10 (step S104: YES), the controlling unit 80 then executes a viscosity estimating processing (step S105).

The viscosity estimating processing in step S105 will be explained. In the present embodiment, data (corresponding to "viscosity estimation data" of the present disclosure) in a table format as depicted in FIG. 8A is stored in the flash memory 84. In the table, the driving voltages (V1, V2, V3) and the kinds of the ink droplets (small droplet, medium droplet, large droplet) are associated with the maximum values (W1*a*, W1*b*, W1*c*, W2*a*, W2*b*, W2*c*, W3*a*, W3*b*, W3*c*) of the viscosity of the ink droplets dischargeable from the nozzle 10.

Note that in the present embodiment, the information regarding the driving voltages (V1, V2, V3) and the information regarding the kinds of ink droplets (small droplet, medium droplet, large droplet) correspond to "discharge energy information" of the present disclosure. Further, among the discharge energy information, the information regarding the driving voltages (V1, V2, V3) corresponds to "voltage information" of the present disclosure, and the information regarding the kinds of ink droplets (small droplet, medium droplet, large droplet) corresponds to "liquid droplet kind information" of the present disclosure. Further, the information regarding the viscosity of the ink (W1*a*, W1*b*, W1*c*, W2*a*, W2*b*, W2*c*, W3*a*, W3*b*, W3*c*) in the table in FIG. 8A corresponds to "viscosity information" of the present disclosure. W1*a*, W1*b*, W1*c*, W2*a*, W2*b*, W2*c*, W3*a*, W3*b*, W3*c* correspond to "estimated viscosities" of the present disclosure.

Here, as the driving voltage applied to the individual electrode 54 is higher, a larger discharge energy is applied to the ink inside the pressure chamber 40. Accordingly, as the driving voltage applied to the individual electrode 54 is higher, the ink is discharged from the nozzle 10 more easily, and the maximum value of the viscosity of the ink dischargeable from the nozzle 10 is greater. Further, as the volume of the ink droplet discharged from the nozzle 10 is greater, a larger discharge energy is applied to the ink inside the pressure chamber 40. Accordingly, as the volume of the ink droplet discharged from the nozzle 10 is greater, the ink is discharged from the nozzle 10 more easily, and the maximum value of the viscosity of the ink dischargeable from the nozzle 10 is greater.

From the above-described matters, in the table depicted in FIG. 8A, a following magnitude relationship: W1*a*<W1*b*<W1*c*; W2*a*<W2*b*<W2*c*; W3*a*<W3*b*<W3*c*; W1*a*<W2*a*<W3*a*; W1*b*<W2*b*<W3*b*; and W1*c*<W2*c*<W3*c* is satisfied. Namely, as the driving voltage is higher and as the volume of the discharged ink droplet is greater, the maximum value of the viscosity of the ink droplet dischargeable from the nozzle 10 is greater. Further, in the viscosity estimating processing in step S105, among the viscosities of the table in FIG. 8A, a viscosity corresponding to the driving voltage which is currently set and the kind of the ink droplet which is currently set is estimated to be the viscosity of the ink inside the individual channel 46.

On the other hand, in the case that the ink is not discharged from the nozzle 10 (step S104: NO), the controlling unit 80 sets the settings of the driving voltage and the waveform signal to next settings (step S107), except for a case that the driving voltage is set to V3 and that the kind of the ink droplet is set to the large droplet (step S106: NO), and returns to step S103.

The processing in step S107 will be explained. In the present embodiment, data (corresponding to "discharge difficulty-level data) in a table format in which the driving voltages (V1, V2, V3) and the kinds of the liquid droplet (small droplet, middle droplet, large droplet) are associated with the order of setting (1, 2, 3, . . . 9), as depicted in FIG. 8B, is stored in the flash memory 84. Note that in the present embodiment, the information regarding the order of the setting (1, 2, 3, . . . 9) corresponds to "difficulty-level information" of the present embodiment. The term "difficulty-level information" indicates the difficulty level (degree of difficulty) of discharging the liquid droplet from the nozzle 10. Specifically, as the value of the order of the setting (1, 2, 3, . . . 9) is greater, the order of the setting indicates that the difficulty level of discharging the ink droplet from the nozzle 10 is lower.

In the table of FIG. 8B, in a case that the driving voltages are the same, then as an ink droplet has a smaller volume, the order therefor is prior than that of another ink droplet having a greater volume. Further, in a case that the kind of the ink droplets are the same, then as a driving voltage is lower, the order therefor is prior than that of another driving voltage which is higher. With this, the voltage information and the kind of the ink droplet are set in an order from a setting in which the difficulty level of discharging is high (in which the driving voltage is lower and the volume of the ink droplet is smaller) to a setting in which the difficulty level of discharging is low (in which the driving voltage is higher and the volume of the ink droplet is greater). Here, in the table of FIG. 8B, the order of the waveform signal for the small droplet at the driving signal V1 is "1" (the difficulty level of discharging the ink droplet from the nozzle 10 is the highest); therefore, in step S102, the driving voltage is set to V1 and the kind of the liquid droplet is set to the small droplet, as described above. Further, in step S107, each of the value of the setting of the driving voltage and the value of the setting of the kind of the ink droplet are changed from the value of the current setting to a value of the next setting, based on the table of FIG. 8B.

On the other hand, in a case that the ink is not discharged from the nozzle 10 (step S104: NO), and that the driving voltage is set to V3 and the kind of the liquid droplet is set to the large droplet (step S106: YES), then the controlling unit 80 estimates that the viscosity of the ink inside the individual channel 46 is W0 (step S108). The viscosity W0 is a viscosity higher than W3*c* as indicated in FIG. 8A (namely, the maximum value of the viscosity of the ink droplet dischargeable from the nozzle 10 in a case that the driving voltage is V3 and that the kind of the ink droplet is the large droplet).

After the viscosity of the ink inside the individual channel 46 is estimated in step S105 or in step S108, in a case that the estimation of the viscosity of the ink has not been completed for all the individual channels 46 in the ink-jet head 4 (step S109: NO), the controlling unit 80 then changes an individual channel 46 which is to be the target of the viscosity estimation (step S110), and returns to step S102.

In step S110, it is allowable to set, as the target of viscosity estimation, an individual channel 46 for which the estimation of the viscosity has not been performed yet. For example, such a case is presumed that among the individual channels 46 corresponding to a certain nozzle row 9, a certain individual channel 46 which is different from a downstream-most individual channel 46 located on the downstream-most side of the conveyance direction is set as the target of the viscosity estimation. In this case, in step S110, another individual channel 46 which is adjacent to the certain individual channel 46 on the downstream side in the conveyance direction is set as the target of the viscosity estimation. Further, for example, such a case is also presumed that among the individual channels 46 corresponding to the certain nozzle row 9, the downstream-most individual channel 46 is set as the target for the viscosity estimation. In this case, in step S110, among the individual channels 46 corresponding to another nozzle row 9 which is adjacent to the certain nozzle row 9 on the left side, an upstream-most individual channel 46 located on the upstream-most side of the conveyance direction is set as the target of the viscosity estimation.

Then, in a case that the estimation of the viscosity of the ink has been completed for all the individual channels 46 in the ink-jet head 4 (step S109: YES), then the controlling unit 80 performs setting for a case of recording an image on a recording sheet P based on the estimated viscosity of the ink (step S111). Then, the controlling unit 80 performs setting of the suction purge (step S112), and performs setting of the flushing of driving the driving element 50 so as to discharge the ink inside the ink-jet head 4 from the nozzles 10 (step S113), and ends the processing.

In step S111, for example, as the average value of the viscosities of the ink inside the individual channels 46 is higher, the controlling unit 80 sets the driving voltage, which is to be applied from the head power source circuit 89 to the driver IC 59 in a case of recording an image on the recording sheet P by discharging ink droplets from the nozzles 10, to be a higher voltage. Alternatively, for example, as the viscosity of the ink regarding each of the individual channels 46 is higher, the controlling unit 80 changes at least a part of the waveform signals of the large droplet, middle droplet and small droplet to a waveform signal corresponding to an ink droplet of which volume is larger.

In step S112, for example, as the average value of the viscosities of the ink inside the individual channels 46 is higher, the controlling unit 80 makes an amount of the ink which is to be discharged by the suction purge to be greater (makes a driving time of the suction pump 62 to be longer).

In step S113, for example, as the viscosity of the ink is higher in a certain individual channel 46, the controlling unit 80 makes a number of times, of the flushing which is to be performed for the certain individual channel 46 immediately before an initial recording pass therefor to be greater, to thereby increase an amount of the ink discharged from the certain individual channel 46.

[Effects]

In the present embodiment, the data in the table format as depicted in FIG. 8A is stored in the flash memory 84. In the data in the table format, the driving voltages to be applied to the driving element 50 and the kinds of the ink droplets are associated with the information regarding the maximum values of the viscosity of the ink dischargeable from the nozzle 10 in the cases that the driving element 50 is driven by the waveform signals corresponding to the driving voltages and the kinds of the ink droplet, respectively. Then, the driving element 50 is driven while changing the setting of the driving voltage and the setting of the kind of the ink droplet (the setting of waveform signal), and the viscosity of the ink inside the individual channel 46 is estimated based on whether or not the ink is discharged from the nozzle 10 and based on the table of FIG. 8A. Since the table is previously prepared, it is sufficient that whether or not the ink is discharged from the nozzle 10 can be detected. Accordingly, the viscosity of the ink inside the individual channel 46 can be estimated without performing any complicated processing.

Further, in the present embodiment, it is possible to output a signal, depending on whether or not the nozzle 10 satisfies the predetermined discharging performance, from the determining circuit 68, based on the change in the voltage value (electrical change) in the detecting electrode 66 in a case that the ink is discharged from the nozzle 10 toward the detecting electrode 66.

Furthermore in the present embodiment, in a case that the other conditions are same, then as the driving voltage is higher when the driving element 50 is driven, it is possible to discharge, from the nozzle 10, the ink of which viscosity is higher, as described above. Moreover, in a case that the other conditions are same, then as the volume of the liquid droplet to be discharged is greater when the driving element 50 is driven, it is possible to discharge, from the nozzle, the ink of which viscosity is higher, as described above. Accordingly, in the present embodiment, the voltage information and the kind of the ink droplet (waveform signal) are set in the order from a setting in which the difficulty level of discharging the ink droplet from the nozzle 10 is high (in which the driving voltage is lower and the volume of the ink droplet is smaller) to a setting in which the difficulty level of discharging the ink droplet from the nozzle 10 is low (in which the driving voltage is higher and the volume of the ink droplet is greater); and the driving element 50 is driven. Then, the viscosity of the ink inside the individual channel 46 is estimated based on the driving voltage and the kind of the ink droplet in a case of discharging the ink from the nozzle 10 for the first time and based on the table of FIG. 8A. In this case, there is no need to further drive the driving element 50 by a setting of the driving voltage and a setting of the kind of ink droplet in which the difficulty level of discharging the ink droplet from the nozzle 10 is lower. Accordingly, it is possible to make the amount of the ink consumed for estimating the viscosity of the ink inside the individual channel 46 to be small. Further, it is also possible to make time required for estimating the viscosity of the ink inside the individual channel 46 to be short as much as possible.

Here, unlike the present embodiment, it is conceivable to determine whether or not the nozzle 10 satisfies the predetermined discharging performance based on a flying velocity of the ink discharged from the nozzle 10 (for example, based on whether or not the flying velocity is not less than a predetermined velocity). In this case, it is allowable to drive the driving element 50 while changing the setting of the driving voltage and the setting of the kind of ink droplet (waveform signal). However, the flying velocity of the ink is easily influenced by any disturbance. Accordingly, there is required, for example, any processing for removing the influence of the disturbance from the result of this determination of the flying velocity, in order to correctly estimate the viscosity of the ink based on the result of the determination. In contrast, the result of determination as to whether or not the ink is discharged from the nozzle 10 in the present embodiment is hardly influenced by the disturbance as described above. Therefore, it is possible to easily and correctly estimate the viscosity of the ink inside the individual channel 46 based on the result of this determination.

Further, in the present embodiment, the suction purge can be performed appropriately depending on the estimated viscosity of the ink by, for example, making the amount of the ink to be discharged in the suction purge to be greater (for example, the driving time of the suction pump 62 is made longer), as the average value of the estimated viscosities of the ink inside the individual channels 46 is higher.

Furthermore, in the present embodiment, for example, regarding each of the individual channels 46, as the estimated viscosity of the ink is higher, it is allowable to make the number of time of the flushing to be performed therefor before the initial recording pass to be greater. Namely, it is possible to perform the flushing appropriately depending on the estimated viscosity of the ink.

Moreover, in the present embodiment, it is allowable, for example, to make the driving voltage to be applied from the head power source circuit 89 to the driver IC 59 to be higher, as the average value of the viscosities of the ink inside the individual channels 46 is higher. Alternatively, regarding each of the individual channels 46, it is allowable, for example, to change at least a part of the waveform signals that are the large droplet, medium droplet and small droplet to a waveform signal corresponding to an ink droplet of which volume is greater, as the viscosity of the ink inside each of the individual channels 46 is higher. Namely, in a case that the ink is discharged from the nozzle 10 toward the recording sheet P, it is possible to drive the driving element 50 appropriately based on the estimated viscosity of the ink, so as to apply the pressure to the ink inside the pressure chamber 40.

<Modifications>

In the foregoing, the embodiment of the present disclosure has been explained. The present embodiment, however, is not limited to or restricted by the above-described embodiment; it is allowable to make a various kind of changes to the present disclosure, within the scope described in the claims.

In the above-described embodiment, the viscosity of the ink inside all the individual channels 46 is estimated. The present disclosure, however, is not limited to this configuration.

Figure 9:
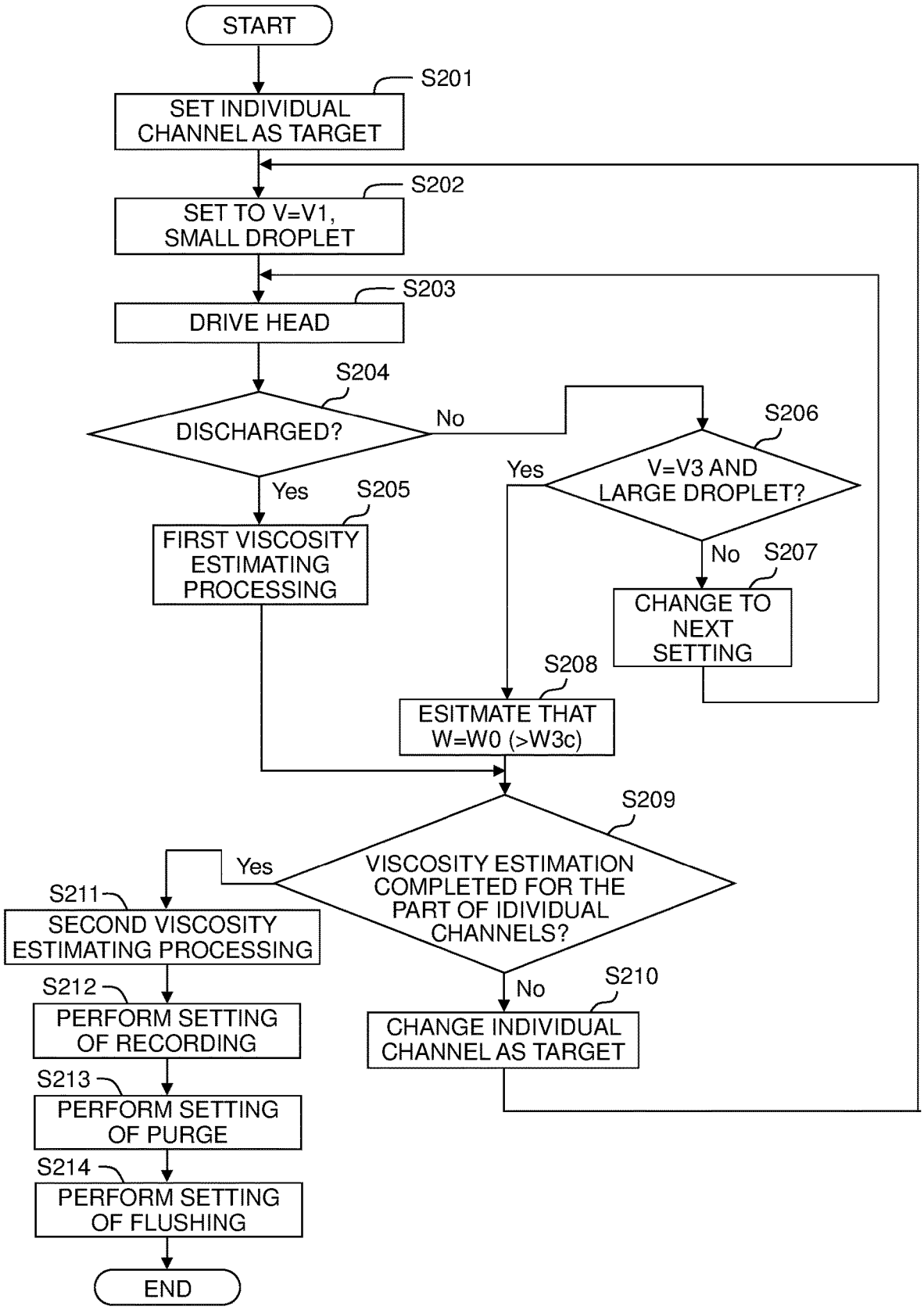
FIG. 9 is a flow chart in a modification, corresponding to FIG. 7.

In a modification, the controlling unit 80 sets the driving voltage and the kind of liquid droplet (waveform signal) with respect to only a part of the individual channels 46 corresponding to each of the nozzle rows 9 and drives the driving elements 50 by processing in steps S201 to S210 as depicted in FIG. 9. Then, the controlling unit 80 estimates the viscosity of the ink based on the driving voltage and the kind of the ink droplet at a time when the ink has been discharged from the nozzles 10 for the first time, and based on the table of FIG. 8A. Here, a first viscosity estimating processing in step S205 is a processing similar to the viscosity estimating processing in step S105 of the above-described embodiment. Further, in step S209, the controlling unit 80 determines as to whether or not the estimation of the viscosity of the ink has been completed to all the above-described parts of the individual channels 46. Furthermore, in step S210, the controlling unit 80 sets, as the individual channel(s) 46 as the target for the viscosity estimation, an individual channel or channels 46 which is included in the above-described part of the individual channels 46 and for which the estimation of the viscosity has not been performed. Moreover, processing in steps S201 to S204 and processing in steps S206 to S209 are processing similar to those in steps S101 to S104 and those in steps S106 to S109, respectively.

Further, in a case that the estimation of the viscosity of the ink is completed with respect to all the part of the individual channels 46 (step S209: YES), the controlling unit 80 then performs a second viscosity estimating processing (step S211). In the second viscosity estimating processing, the controlling unit 80 estimates the viscosity of the ink inside an individual channel 46 which is included in the plurality of individual channels 46 in the ink-jet head 4 and which is different from the part of the above-described individual channels 46, based on the viscosity of the ink inside the above-described part of the individual channels 46 estimated in the first viscosity estimating processing in step S205.

For example, in a case that a certain individual channel 46 of which viscosity is not estimated in the first viscosity estimating processing is arranged in the conveyance direction between two individual channels 46 of which viscosities have been estimated in the first viscosity estimating processing, the controlling unit 80 estimates the viscosity of the ink inside the certain individual channel 46 to be an intermediate viscosity between the two viscosities of the ink inside the two individual channels 46.

Further, in a case that individual channels 46 are connected to a same manifold channel 41, a new ink flows with more difficulty, into an individual channel 46 positioned further on the downstream side in the conveyance direction which is far from the supply port 39, and an old ink easily remain or accumulates in such an individual channel 46. Namely, the viscosity of the ink is high in such an individual channel 46. In view of this situation, in a case, for example, that there is an individual channel 46 for which the viscosity is not estimated in the first viscosity estimating processing and which is positioned on the upstream side (on the side of the supply port 39) in the conveyance direction relative to another individual channel 46 for which the viscosity has been estimated in the first viscosity estimating processing, the controlling unit 80 estimates the viscosity of the ink in the individual channel 46 on the upstream side to be lower than the viscosity of the ink in the another individual channel for which the viscosity has been estimated in the first viscosity estimating processing. Further in this case, the controlling unit 80 estimates the viscosity of the ink in the individual channel 46 on the upstream side to be further lower than the viscosity of the ink in the other individual channel for which the viscosity has been estimated, as the individual channel 46 on the upstream side is positioned closer to the upstream side in the conveyance direction.

Furthermore, in a case, for example, that there is an individual channel 46 for which the viscosity is not estimated in the first viscosity estimating processing and which is positioned on the downstream side (on the side opposite to the supply port 39) in the conveyance direction relative to another individual channel 46 for which the viscosity has been estimated in the first viscosity estimating processing, the controlling unit 80 estimates the viscosity of the ink in the individual channel 46 on the downstream side to be higher than the viscosity of the ink in the another individual channel for which the viscosity has been estimated in the first viscosity estimating processing. Further in this case, the controlling unit 80 estimates the viscosity of the ink in the individual channel 46 on the downstream side to be further higher than the viscosity of the ink in the other individual channel for which the viscosity has been estimated, as the individual channel 46 on the downstream side is positioned closer to the downstream side in the conveyance direction.

Then, the controlling unit 80 performs settings (steps S212 to S214), which are similar to those performed in steps S111 to S113 of the first embodiment, based on the viscosities of the ink inside the respective individual channels 46 estimated in the first viscosity estimating processing in step S205 and the second viscosity estimating processing in step S211.

In a case that the individual channels 46 are connected to the same manifold 41, it is possible to estimate, based on the viscosity of the ink inside a certain individual channel(s) 46, the viscosity of the ink inside another (other) channel(s) 46. In view of this, in the present modification, the controlling unit 80 sets, in the first viscosity estimating processing, the driving voltage and the kind of liquid droplet (waveform signal) only for the part of the plurality of individual channels 46 in the ink-jet head 4 and drives the driving elements 50. Further, the controller 80 estimates the viscosity of the ink based on the driving voltage and the kind of ink droplet at the time when the ink has been discharged from the nozzles 10 for the first time, and based on the table of FIG. 8A. Then, in the second viscosity estimating processing, the controlling unit 80 estimates the viscosity of the ink inside the individual channel 46 which is different from the above-described part of the plurality of individual channels 46, based on the viscosity of the ink estimated regarding the above-described part of the plurality of individual channels 46. In this case, it is possible to make the amount of the ink consumed for estimating the viscosity of the ink to be smaller, since the ink is not discharged from the nozzle(s) 10 of the individual channel(s) 46 which is/are different from the part of the plurality of individual channels 46. Further, the time required for estimating the viscosity of the ink is also shortened.

Further, the settings performed in the step S111 are not limited to those explained in the above-described embodiment. For example, in step S111, it is allowable to divide the individual channels 46 corresponding to each of the nozzle rows 9 into a plurality of groups arranged side by side in the conveyance direction, and to set the wave signal for each of the groups, based on the estimated viscosity. Alternatively, for example, in a case that it is possible to individually set, in the printer, the driving voltages to be applied to the individual electrodes 54 of the driving elements 50, respectively, then it is allowable to set the driving voltage to be applied to a certain individual electrode 54, among the individual electrodes 54, to be higher, as the viscosity of the ink is higher in a certain individual channel 46, among the individual channels 46, to which the certain individual electrode 54 corresponds.

Furthermore, in the above-described embodiment, the setting for performing recording of an image on the recording sheet P, the setting for the suction purge and the setting for the flushing are performed based on the estimated viscosity of the ink inside the individual channel 46. The present disclosure, however, is not limited to this configuration. It is allowable to perform only a part of these settings. Alternatively, it is allowable to use the estimated viscosity of the ink inside the individual channel 46 for a purpose different from these settings.

Moreover, in the present embodiment, although the ink(s) inside the ink-jet head 4 is (are) discharged from the nozzles 10 by the suction purge, the present disclosure is not limited to this configuration. For example, it is allowable to provide a pressure pump at an intermediate part of the tubes 13 connecting the sub tank 3 to the ink cartridges 15. Further, it is allowable to drive the pressure pump in a state that the nozzles 10 are covered by the cap 61 to thereby perform a so-called pressure purge of pressurizing the ink inside the ink-jet head 4 and of discharging the ink inside the ink-jet head 4 from the nozzles 10. Note that in this case, the cap 61 and the pressure pump correspond to a "purge unit" of the present disclosure.

Further, in the purge, it is allowable to perform both of the suction by the suction pump 62 and the pressurization by the pressure pump. In this case, the maintenance unit 8 and the pressure pump correspond to the "purge unit" of the present disclosure.

Furthermore, in the above-described embodiment, the driving voltage and the kind of liquid droplet (waveform signal) are both changed so as to drive the driving element 50 to thereby estimate the viscosity of the ink inside the individual channel 46. The present disclosure, however, is not limited to this configuration.

For example, in order to estimate the viscosity of the ink inside the individual channel 46, it is allowable to change only the driving voltage so as to drive the driving element 50, without changing the kind of the liquid droplet (waveform signal). Further, in the above case, in a case that the driving voltage is changed in the order from the lower value of the driving voltage to the higher value of the driving voltage, it is possible to determine whether or not the ink is discharged from the nozzle 10, in the order of the setting in which the difficulty level of the discharging the ink droplet from the nozzles 10 is high to the setting in which the difficulty level of discharging the ink droplet from the nozzles 10 is low.

Alternatively, in order to estimate the viscosity of the ink inside the individual channel 46, it is allowable, for example, to change only the kind of the liquid droplet (waveform signal) so as to drive the driving element 50, without changing to the driving voltage. Further, in the above case, in a case that the volume of the ink droplet is changed in the order from the smaller value to the greater value, it is possible to determine whether or not the ink is discharged from the nozzle 10, in the order of the setting in which the difficulty level of the discharging the ink droplet from the nozzles 10 is high to the setting in which the difficulty level of discharging the ink droplet from the nozzles 10 is low.

Further, in the above-described embodiment, in the case of estimating the viscosity of the ink inside the individual channels 46, the driving voltage and the kind of the ink droplet are changed, in the order from the setting in which the difficulty level of the discharging the ink droplet from the nozzles 10 is high to the setting in which the difficulty level of discharging the ink droplet from the nozzles 10 is low. The present disclosure, however, is not limited to this configuration. For example, it is allowable to change the driving voltage and the kind of ink droplet with respect all of a plurality of settings regarding the driving voltage and the kind of liquid droplet in an arbitrary order, and to estimate the viscosity of the ink inside the individual channel 46 based on the result of the determination as to whether or not the ink is discharged from the nozzle 10 in each of the settings, and based on the table of FIG. 8A.

Further, in the case of estimating the viscosity of the ink inside the individual channel 46, the present disclosure is not limited to the configuration wherein the head power source circuit 89 selectively generates any one of the plurality of kinds of driving voltages, and it not limited also to the configuration wherein the driver IC 59 selectively generates any one of the plurality of kinds of waveform signals in accordance with the kinds of ink droplets and outputs the selectively generate waveform signal to each of the individual electrodes 54. For example, in the case of estimating the viscosity of the ink inside the individual channel 46, it is allowable that the head power source circuit 89 generates only one kind of the driving voltage, and that the driver IC 59 generates only one kind the waveform signal and outputs the one kind of the waveform signal to each of the individual electrodes 54. In this case also, it is possible to estimate (determine) as to whether or not the viscosity of the ink inside the individual channel 46 is not less than a certain viscosity, based on whether or not the ink is discharged from the nozzle 10 in a case that the driving elements 50 are driven with the driving voltage and the waveform signal.

Furthermore, in the above-described embodiment, in the case of estimating the viscosity of the ink inside the individual channel 46, the driving voltage and the kind of the ink droplet are set to be same as the driving voltage and the kind of the ink droplet in the case of recording an image on a recording sheet P. The present disclosure, however, is not limited to this configuration. In the case of estimating the viscosity of the ink inside the individual channel 46, at least part of the driving voltage and the kind of the ink droplet which are to be set may be different from the driving voltage and the kind of the ink droplet in the case of recording an image on a recording sheet P.

Moreover, in the above-described embodiment, the table in which the driving voltages and the kinds of the ink droplets are associated with maximum values of the viscosity of the ink dischargeable from the nozzle 10 is stored in the flash memory 84. The present disclosure, however, is not limited to this. It is also allowable that a table, in which the information regarding the driving voltages and the information regarding the kinds of the ink droplets are associated with information regarding the viscosity of the ink, which is different from the information regarding the maximum values of the viscosity of the ink dischargeable from the nozzle 10, is stored in the flash memory 84.

Further, in the above-described example, the driving voltage and the kind of ink droplet are set so as to drive the driving element 50, thereby applying the discharge energy to the ink inside the pressure chamber 40. The present disclosure, however, is not limited to this configuration. It is also allowable to set discharge energy information which is different from the driving voltage and the kind of ink droplet, and to thereby apply the discharge energy to the ink inside the pressure chamber 40.

Furthermore, in the above-described embodiment, the determination is made as to whether or not the ink is discharged from the nozzle 10 by utilizing the voltage value used in the case that the ink is discharged from the nozzle 10 toward the detecting electrode 66. The present disclosure, however, is not limited to this configuration.

It is allowable, for example, to arrange a detecting electrode which extends in the up-down direction, and to determine as to whether or not the ink is discharged from the nozzle 10 by utilizing a voltage value used in a case that the ink is discharged so that the ink passes through an area facing the detecting electrode. Alternatively, it is also allowable, for example, to provide an optical sensor configured to detect the ink from the nozzle 10, and to determine as to whether or not the ink is discharged from the nozzle 10 based on a result of the detection by the optical sensor.

Alternatively, it is allowable, for example, to connect a voltage detecting circuit (corresponding to a "signal outputting circuit" of the present disclosure) configured to detect the change in the voltage in a case that the ink is discharged from the nozzle, to a plate formed with the nozzles of the ink-jet head, in a similar manner as described in Japanese Patent No. 4929699, and to output a signal from the voltage detecting circuit to the controlling unit 80, depending on whether or not the nozzle 10 satisfies the predetermined discharging performance.

Further, in the above-described embodiment, the determination is made in step S105 as to whether or not the nozzle 10 satisfies the predetermined discharging performance based on whether or not the ink is discharged from the nozzle 10. The present disclosure, however, is not limited to this configuration. It is allowable, for example, to provide a configuration for detecting a flying velocity of the ink discharged from the nozzle 10. Further in a case that a signal indicating that the flying velocity is not less than a predetermined flying velocity is outputted from the above-described configuration, it is allowable to determine that the nozzle 10 satisfies the predetermined discharging performance. Alternatively, it is allowable to provide a configuration for detecting a flying direction of the ink discharged from the nozzle 10. Further, in a case that a signal indicating that the flying direction is a predetermined direction, it is allowable to determine that the nozzle 10 satisfies the predetermined discharging performance.

Furthermore, in the above-described embodiment, the head power source circuit 89 applies the driving voltage to the driver IC 59, and the driver IC 59 generates the waveform signal and outputs the generated waveform signal to the driving element 50. The present disclosure, however, is not limited to this configuration. For example, it is allowable that any driver IC is not provided, that the head power source circuit 89 applies the driving voltage to the ASIC 85 of the controlling unit 80, and that the ASIC 85 generates the waveform signal and outputs the generated waveform signal to the driving element 50, thereby applying the driving voltage to the driving element 50.

Moreover, in the above-described embodiment, the pressure is applied to the ink inside the pressure chamber 40 by the driving element 50, to thereby apply, to the ink inside the individual channel 46, the discharge energy for discharging the ink from the nozzle 10. The present disclosure, however, is not limited to this. It is allowable, for example, to heat the ink so as to generate an air bubble inside the ink channel, thereby applying, to the ink inside the individual channel, the discharge energy for discharging the ink from the nozzle 10. Note that in this case, a heating element configured to heat the ink, etc., corresponds to the "energy applying part" of the present disclosure.

Further, although the foregoing explanation has been given about the example wherein the present disclosure is applied to the printer which discharges the ink from the nozzles to thereby perform recording on the recording sheet P, the present disclosure is not limited to this configuration. For example, it is also possible to apply the present disclosure to a liquid droplet discharging apparatus which is configured to discharge a liquid different from the ink, for example, a liquified resin or metal, etc.

What is claimed is:

1. A liquid droplet discharging apparatus comprising:
- a discharging head having:
  - a liquid channel including a nozzle; and
  - an energy applying part configured to apply, to liquid inside the liquid channel, discharge energy for discharging a liquid droplet of the liquid from the nozzle;
- a controller; and
- a signal outputting circuit configured to output signals to the controller depending on whether the nozzle satisfies a predetermined discharging performance,
- wherein the controller is configured to determine whether the nozzle satisfies the predetermined discharging performance based on the output signals outputted from the signal outputting circuit; and
- the controller is configured to estimate viscosity of the liquid inside the discharging head based on:
  - viscosity estimation data in which discharge energy information regarding the discharge energy and viscosity information regarding the viscosity of the liquid inside the liquid channel are associated with each other, and
  - a result of the determination performed in a case that the controller controls the energy applying part based on the discharge energy information and that the discharge energy is thereby applied to the liquid inside the liquid channel.

2. The liquid droplet discharging apparatus according to claim 1, wherein in a case that the liquid droplet is discharged from the nozzle, the signal outputting circuit is configured to output a signal indicating that the nozzle satisfies the predetermined discharging performance.

3. The liquid droplet discharging apparatus according to claim 1, wherein in a case that a flying velocity of the liquid droplet discharged from the nozzle is not less than a predetermined velocity, the signal outputting circuit is configured to output a signal indicating that the nozzle satisfies the predetermined discharging performance.

4. The liquid droplet discharging apparatus according to claim 1, wherein in a case that a flying direction of the liquid droplet discharged from the nozzle is a predetermined direction, the signal outputting circuit is configured to output a signal indicating that the nozzle satisfies the predetermined discharging performance.

5. A liquid droplet discharging apparatus comprising:

a discharging head having:

a liquid channel including a nozzle; and an energy applying part configured to apply, to liquid inside the liquid channel, discharge energy for discharging a liquid droplet of the liquid from the nozzle;

a signal outputting circuit configured to output signals depending on whether the nozzle satisfies a predetermined discharging performance; and a controller, wherein the controller is configured to determine whether the nozzle satisfies the predetermined discharging performance; and the controller is configured to estimate viscosity of the liquid inside the discharging head based on:

viscosity estimation data in which discharge energy information regarding the discharge energy and viscosity information regarding the viscosity of the liquid inside the liquid channel are associated with each other, and a result of the determination performed in a case that the controller controls the energy applying part based on the discharge energy information and that the discharge energy is thereby applied to the liquid inside the liquid channel, wherein the discharge energy information indicates discharge energies to be applied to the liquid inside the liquid channel, the viscosity information indicates estimated viscosities of the liquid inside the liquid channel, the viscosity estimation data is data in which the discharge energies and the estimated viscosities are associated with each other, the discharge energies are also associated with difficulty levels of discharging the liquid droplet from the nozzle such that the difficulty levels become lower as the discharge energies become greater, the controller is configured to change the discharge energies to be applied to the liquid inside the liquid channel in a descending order of the difficulty levels associated therewith, and if the controller determines for the first time that the nozzle satisfies the predetermined discharging performance in a case of applying a certain discharge energy, the controller is configured to estimate the viscosity of the liquid inside the liquid channel based on one of the estimated viscosities associated with the certain discharge energy.

6. The liquid droplet discharging apparatus according to claim 5, wherein each of the estimated viscosities is a maximum value of the viscosity of the liquid dischargeable from the nozzle in a case of applying one of the discharge energies associated therewith.

7. The liquid droplet discharging apparatus according to claim 5, wherein the discharge energy information includes voltage information which indicates voltages to be applied to the energy applying part, and the discharge energies become greater as the voltages become greater.

8. The liquid droplet discharging apparatus according to claim 7, wherein the discharge energy information includes liquid droplet kind information which indicates volumes of the liquid droplet to be discharged from the nozzle, and the discharge energies become greater as the volumes of the liquid droplet become greater.

9. The liquid droplet discharging apparatus according to claim 8, wherein the controller is configured to output, to the energy applying part, waveform signals corresponding to the volumes of the liquid droplet to be discharged from the nozzle.

10. The liquid droplet discharging apparatus according to claim 7, further comprising a voltage generator configured to generate the voltages, and the controller is configured to apply, to the energy applying part, the voltages generated by the voltage generator.

11. The liquid droplet discharging apparatus according to claim 1, further comprising a detecting electrode, wherein the signal outputting circuit is configured to output the signals depending on whether the nozzle satisfies the predetermined discharging performance, based on an electric change occurring in the detecting electrode by the liquid droplet discharged from the nozzle.

12. The liquid droplet discharging apparatus according to claim 1, wherein the signal outputting circuit is configured to output a signal indicating that the nozzle does not satisfy the predetermined discharging performance at least in a case that the liquid droplet is not discharged from the nozzle.

13. The liquid droplet discharging apparatus according to claim 1, further comprising a purge unit configured to perform a purge of discharging the liquid inside the discharging head from the nozzle, wherein the controller is configured to control the purge unit to perform the purge based on the estimated viscosity of the liquid.

14. The liquid droplet discharging apparatus according to claim 1, wherein the controller is configured to control the energy applying part to perform a flushing of discharging the liquid from the nozzle, based on the estimated viscosity of the liquid.

15. The liquid droplet discharging apparatus according to claim 1, wherein in a case that the controller controls the energy applying part to discharge the liquid droplet from the nozzle toward a medium, the controller is configured to control the energy applying part based on the estimated viscosity of the liquid.

16. The liquid droplet discharging apparatus according to claim 15, further comprising a voltage generator, wherein the energy applying part is configured to apply pressure to the liquid inside the liquid channel in a case that a driving voltage generated by the voltage generator is applied to the energy applying part, and in a case that the controller controls the energy applying part to discharge the liquid droplet from the nozzle toward the medium, the controller is configured to control the voltage generator to generate the driving voltage corresponding to the estimated viscosity of the liquid, and to apply the driving voltage to the energy applying part.

17. The liquid droplet discharging apparatus according to claim 1, wherein the discharging head has:

individual channels which construct the liquid channel, each of the individual channels including the nozzle;

a common channel which communicates with the individual channels and which constructs the liquid channel; and energy applying parts which include the energy applying part and which are configured to apply pressure to the liquid inside the individual channels, respectively, the controller is configured to control individually each of the energy applying parts, the controller is further configured to estimate the viscosity of the liquid inside a part of the individual channels based on the viscosity estimation data and the result of the determination, and the controller is further configured to estimate the viscosity of the liquid in an individual channel, which is different from the part of the individual channels, based on the estimated viscosity of the liquid in the part of the individual channels.

* * * * *